US010487577B1

(12) United States Patent
Fuqua et al.

(10) Patent No.: US 10,487,577 B1
(45) Date of Patent: Nov. 26, 2019

(54) CONVERTIBLE FOLDING LADDER

(71) Applicant: Patriot3, Inc., Fredericksburg, VA (US)

(72) Inventors: Charles Louis Fuqua, Woodbridge, VA (US); Steven Scott Kahre, Spotsylvania, VA (US)

(73) Assignee: PATRIOT3, Inc., Fredericksburg, VA (US)

( * ) Notice: Subject to any disclaimer, the term of this patent is extended or adjusted under 35 U.S.C. 154(b) by 0 days.

(21) Appl. No.: 15/730,261

(22) Filed: Oct. 11, 2017

Related U.S. Application Data

(63) Continuation of application No. 14/142,518, filed on Dec. 27, 2013, now abandoned.

(60) Provisional application No. 61/746,233, filed on Dec. 27, 2012, provisional application No. 61/811,878, filed on Apr. 15, 2013.

(51) Int. Cl.
*E06C 1/38* (2006.01)

(52) U.S. Cl.
CPC ..... *E06C 1/38* (2013.01)

(58) Field of Classification Search
CPC ..... E06C 1/04; E06C 1/08; E06C 1/10; E06C 1/383; E06C 9/085; E06C 7/48; E06C 7/50
See application file for complete search history.

(56) References Cited

U.S. PATENT DOCUMENTS 646,347 A * 3/1900 Betty ..... E06C 1/32 182/24
1,030,905 A * 7/1912 Lucas ..... E06C 7/48 182/206
1,205,594 A * 11/1916 Close ..... E06C 7/48 182/206
1,299,784 A * 4/1919 Sabo ..... E06C 7/48 182/206
1,479,628 A * 1/1924 Seger ..... E06C 1/32 182/24
1,520,414 A * 12/1924 Hamilton ..... E06C 1/10 182/178.3
1,942,210 A * 1/1934 Harting ..... E06C 1/32 182/22
2,755,981 A * 7/1956 Edwards ..... E06C 1/10 182/206
3,216,526 A * 11/1965 Cole ..... E06C 1/10 182/163

(Continued)

FOREIGN PATENT DOCUMENTS

CA 2538708 4/2005
CA 2538708 A1 * 4/2005 ..... E06C 1/18

*Primary Examiner* — Katherine W Mitchell
*Assistant Examiner* — Candace L Bradford
(74) *Attorney, Agent, or Firm* — Schwartz Law Firm, P.C.

(57) ABSTRACT

A convertible folding ladder incorporates first and second rigid ladder sections, each comprising opposing spaced apart longitudinal rails, a plurality of spaced apart rungs between the rails, and a connector plate formed with one end of at least one of the longitudinal rails. Each connector plate of the first ladder section defines at least three spaced apart pin holes adapted for being selectively aligned with pin holes defined by the connector plate of the second ladder section. First and second fastener pins are adapted for being removably inserted through the aligned pin holes, such that the ladder is convertible between multiple different configurations.

8 Claims, 10 Drawing Sheets

(56) References Cited

U.S. PATENT DOCUMENTS 3,231,045 A * 1/1966 Lavrard ..... E06C 1/32 182/164
3,286,789 A * 11/1966 Planchon ..... E06C 1/52 182/163
4,519,478 A * 5/1985 Hulme ..... E06C 1/10 182/178.4
4,524,847 A * 6/1985 Mintz ..... E06C 1/32 182/23
4,531,613 A * 7/1985 Keigher ..... E06C 1/10 182/163
4,687,076 A * 8/1987 Tu ..... E06C 1/10 182/178.2
4,815,564 A * 3/1989 Yoo ..... E06C 1/32 182/160
4,821,843 A * 4/1989 Planchon ..... E06C 1/52 182/163
5,109,954 A * 5/1992 Skyba ..... E06C 1/10 182/100
5,353,892 A * 10/1994 Lu ..... E06C 1/32 16/328
6,343,406 B1 * 2/2002 Yeh ..... E05D 11/1007 16/328
6,457,559 B1 * 10/2002 Schlueter ..... E06C 1/383 182/159
7,044,270 B1 * 5/2006 McIntire ..... E06C 1/36 182/107
8,387,753 B2 * 3/2013 Kieffer ..... E06C 7/088 182/195
8,651,259 B1 * 2/2014 Blehm ..... E06C 1/345 182/104
2010/0281635 A1 * 11/2010 Hemby ..... E01D 15/124 14/69.5
2011/0139544 A1 * 6/2011 Frick ..... E04F 11/002 182/27
2011/0209947 A1 * 9/2011 Allred, III ..... E04C 3/40 182/194
2014/0363228 A1 * 12/2014 Vassilakos ..... E06C 7/50 403/403

* cited by examiner

CONVERTIBLE FOLDING LADDER

TECHNICAL FIELD AND BACKGROUND OF THE INVENTION

This invention relates broadly and generally to a convertible folding ladder. In exemplary embodiments described herein, the present disclosure comprises a tactical (e.g., assault) ladder constructed of multiple modular and interchangeable ladder sections. The exemplary ladder is especially applicable for use by military, law enforcement personnel, and firefighters.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

According to one exemplary embodiment, the present disclosure comprises a convertible folding ladder. The ladder incorporates first and second rigid ladder sections. The first ladder section comprises opposing spaced apart longitudinal rails, a plurality of spaced apart rungs between the rails, and a connector plate (integrally or separately) formed with one end of at least one of the longitudinal rails. The connector plate of the first ladder section defines at least three spaced apart pin holes. The second rigid ladder section comprises opposing spaced apart longitudinal rails, a plurality of spaced apart rungs between the rails, and a connector plate formed with one end of at least one of the rails. The connector plate of the second ladder section defines at least three spaced apart pin holes adapted for being selectively aligned in pairs with pin holes defined by the connector plate of the first ladder section. First and second fastener pins (or other suitable hardware) are adapted for being removably inserted through respective aligned pin holes defined by the connector plates of the first and second ladder sections.

Inserting the first and second fastener pins through a first pair of aligned pin holes formed with respective connector plates arranges the first and second ladder sections in a substantially straight ladder configuration. Inserting the first and second fastener pins through a second pair of aligned pin holes formed with respective connector plates arranges the first and second ladder sections in an obtuse angle configuration. In the obtuse angle configuration, the first and second ladder sections may cooperate with a number of like modular ladder sections to form an arched ladder (e.g., for bridging from one structure to another). Inserting one of the first and second fastener pins through a single aligned pin hole formed with respective connector plates enables arrangement of the first and second ladder sections in an acute angle configuration. In the acute angle configuration, the first and second ladder sections may cooperate with like modular ladder sections to form an A-frame ladder.

According to another exemplary embodiment, in the obtuse angle configuration the first and second ladder sections are arranged at angle of between about 120-170 degrees.

According to another exemplary embodiment, in the acute angle configuration the first and second ladder sections are arranged at angle of between about 0-80 degrees.

According to another exemplary embodiment, at least one rigid spacer is removably attached to the first and second ladder sections in the acute angle configuration.

According to another exemplary embodiment, each of the first and second fastener pins comprises a quick-release spring-loaded detent pin.

According to another exemplary embodiment, at least one breaching hook is removably attached to one of the first and second ladder sections, and is adapted for hanging the ladder from a vertical structure in the substantially straight ladder configuration.

According to another exemplary embodiment, the connector plate comprises an enlarged tapered head forming a standoff adapted for spacing the ladder rungs away from a vertical structure against which the ladder is leaned (resting) in the substantially straight ladder configuration.

According to another exemplary embodiment, the first and second ladder sections comprise respective identical interchangeable modular ladder sections.

According to another exemplary embodiment, each of the modular ladder sections is between 2-4 feet in length.

According to another exemplary embodiment, the ladder comprises at least 6 identical interchangeable modular ladder sections.

In another exemplary embodiment, the disclosure comprises a convertible folding ladder incorporating first and second rigid, modular, interchangeable ladder sections. The first ladder section comprises opposing spaced apart longitudinal rails, at least one rung between the rails, and a connector plate formed with one end of at least one of the rails. The connector plate of the first ladder section defines at least three spaced apart pin holes. The second ladder section comprises opposing spaced apart longitudinal rails, at least one rung between the rails, and a connector plate formed with one end of at least one of the rails. The connector plate of the second ladder section defines at least three spaced apart pin holes adapted for being selectively aligned in pairs with pin holes defined by the connector plate of the first ladder section. First and second fastener pins (or other suitable hardware) are adapted for being removably inserted through respective aligned pin holes defined by the connector plates of the first and second ladder sections.

Inserting the first and second fastener pins through a first pair of aligned pin holes formed with respective connector plates arranges the first and second ladder sections in a substantially straight ladder configuration. Inserting the first and second fastener pins through a second pair of aligned pin holes formed with respective connector plates arranges the first and second ladder sections in an obtuse angle configuration.

According to another exemplary embodiment, each of the interchangeable modular ladder sections is constructed of a lightweight metal, such as aluminum.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
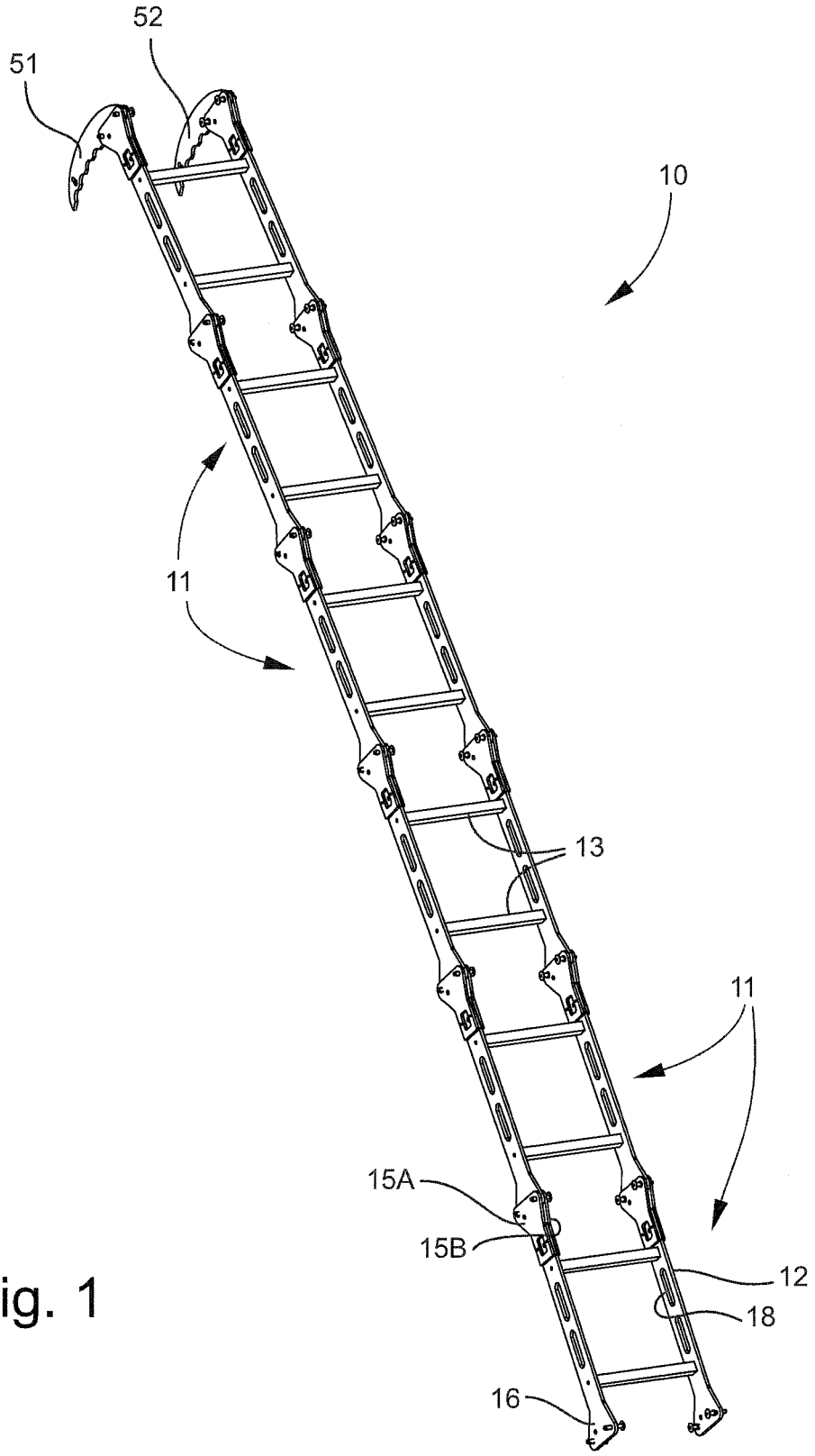
FIG. 1 is a perspective view of the convertible folding ladder according to one exemplary embodiment of the present disclosure, and showing the exemplary ladder in a straight-ladder configuration with breaching hooks deployed for hanging the ladder from a vertical structure.
Figure 2:
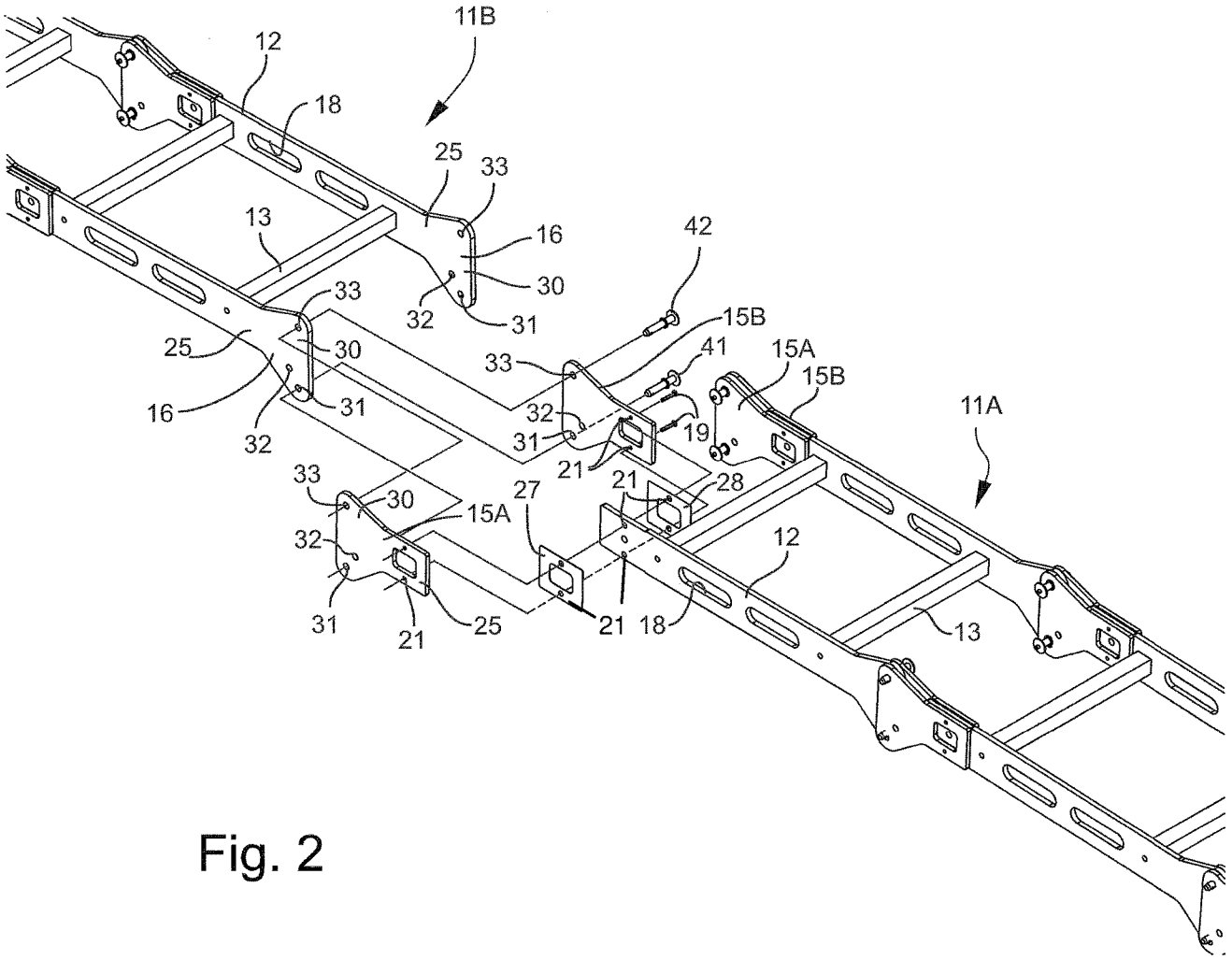
FIG. 2 is a fragmentary perspective view of the exemplary ladder with certain components exploded to demonstrate attachment of one connector plate of a first ladder section to the connector plate of a second adjacent ladder section.
Figure 3:
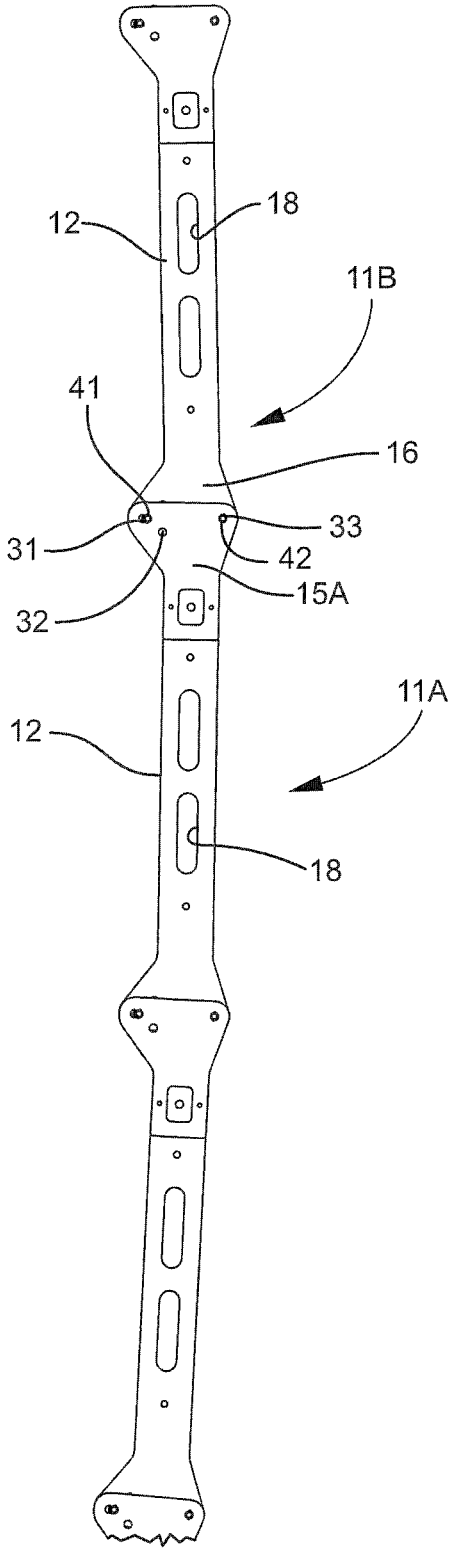
FIG. 3 is a side view showing adjacent ladder sections arranged in a straight-ladder configuration.

Referring now specifically to the drawings, a convertible folding ladder according to one exemplary embodiment of the present disclosure is illustrated in FIG. 1, and shown generally at reference numeral 10. The exemplary ladder 10 is constructed of identical modular rigid ladder sections 11; each section 11 comprising opposing spaced apart longitudinal rails 12, spaced apart rungs 13 attached between the rails 12, and connector plates 15A, 15B and 16 formed with respective opposite ends of each rail 12. The exemplary rails 12 comprise a flat metal with one or more hand openings 18. As best shown in FIGS. 2 and 3, the connector plates 15A, 15B at one end of the ladder section 11A are separately and permanently attached in pairs to the opposing rails 12 using rivets 19 (or other suitable fasteners or fastening means, such welding). The rivets 19 pass through respective aligned rivet holes 21 formed with a neck 25 of each connector plate 15A, 15B, square-shaped washers 27, 28, and the rail 12. The connector plates 16 at the opposite end of the ladder section are integrally formed with the rails 12 (e.g., as a homogenous continuous structure).

Each of the connector plates 15A-15B and 16 has an enlarged head 30 which tapers to the neck 25 (or rail), and defines three spaced apart pin holes 31, 32, and 33. The heads 30 of connector plates 15A, 15B are slightly spaced apart, and precisely aligned on opposite sides of the rail 12. The pin holes 31, 32, 33 defined by separately-attached connector plates 15A, 15B of one ladder section 11A selectively align in cooperating pairs with pin holes 31, 32, 33 defined by the integral connector plates 16 of an adjacent ladder section 11B, and receive quick-release spring-loaded detent pins 41, 42 to hold the ladder sections 11A, 11B together in one of multiple desired configurations. FIGS. 1, 2 and 3 show adjacent ladder sections 11A, 11B joined together in a straight-ladder configuration with quick-release pins 41, 42 inserted through a first pair of aligned pin holes 31, 33 in the connector plates 15A-15B and 16 (of each rail). In this exemplary configuration, the ladder 10 may be hung (suspended) from a vertical structure using breaching hooks 51, 52 attached to respective connector plates 15A, 15B at an end ladder section 11C. When leaned or resting directly against the vertical structure, the enlarged heads 30 of respective connector plates 15A-15B, 16 form standoffs adapted for sufficiently spacing the ladder rungs 13 away from the structure thereby ensuring adequate toe-reveal for climbing.

Figure 4:
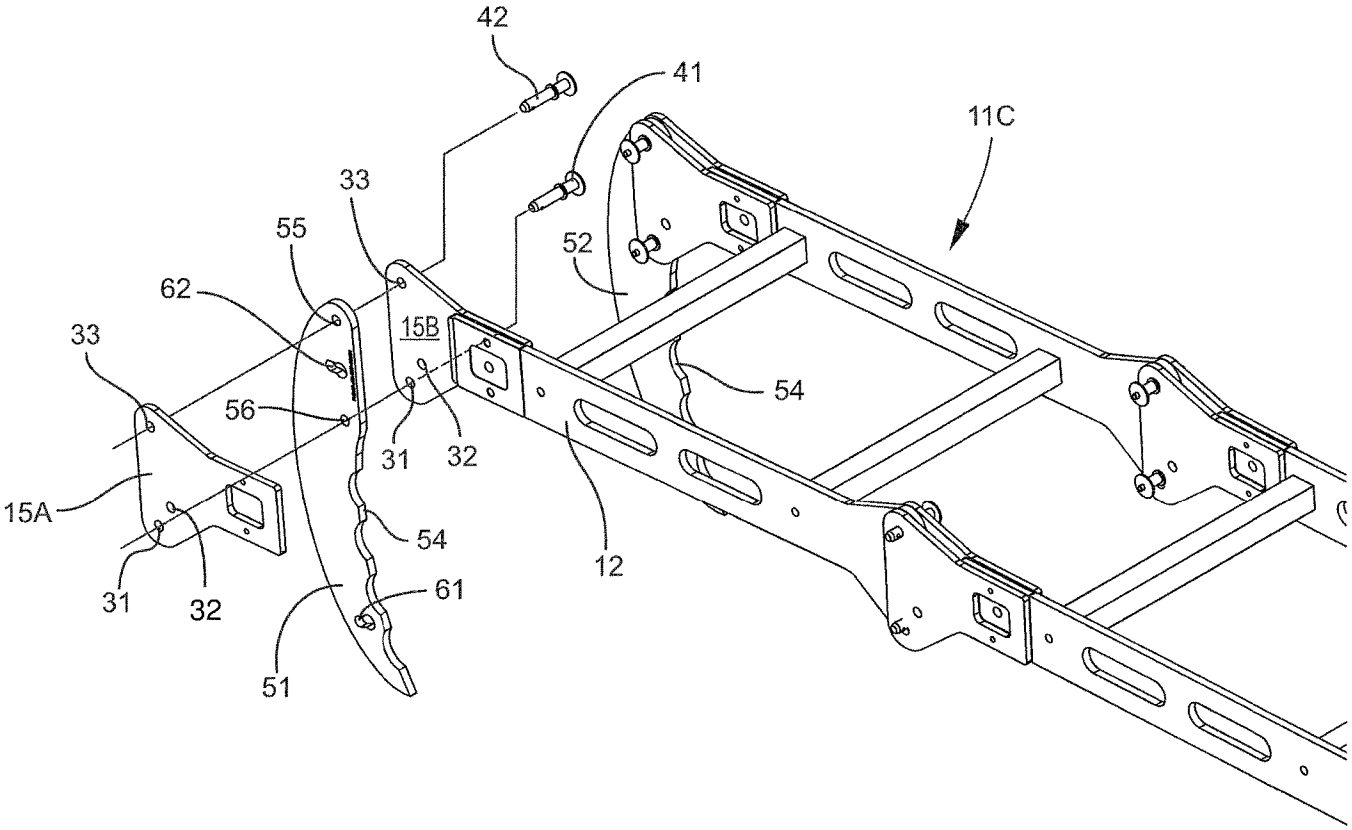
FIG. 4 is a fragmentary perspective view of the exemplary ladder with certain components exploded to demonstrate quick-release attachment of the breaching hook.

As best shown in FIG. 4, each breaching hook 51, 52 has a serrated edge 54, and defines spaced apart pin holes 55, 56 aligned with pin holes 31, 33 of the connector plates 15A, 15B. Quick-release spring-loaded detent pins 41, 42 pass through the aligned holes 31, 33, 55, 56 to securely and removably attach the breaching hooks 51, 52 to the end ladder section 11C. The overall size of the exemplary ladder 10 when deployed in a fully extended configuration (with 6 2-ft modular sections) is 144"L×13" W×5.5" H.

Figure 5:
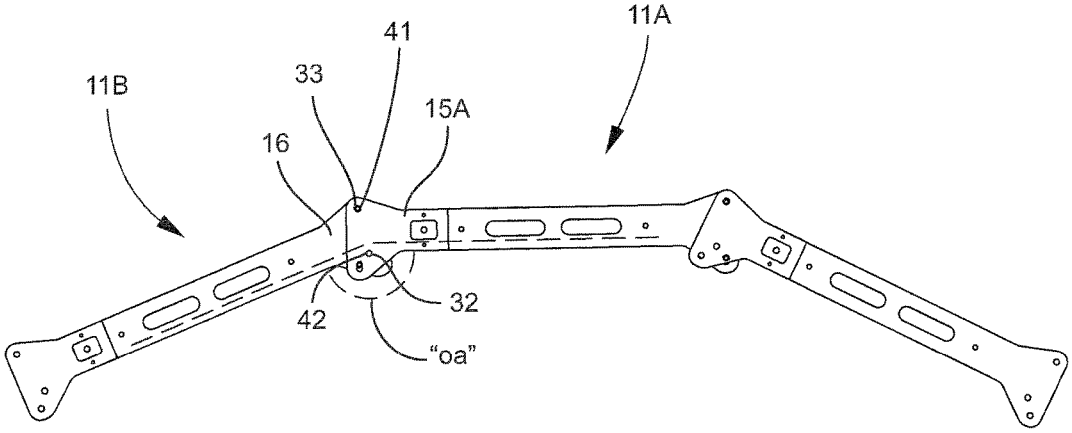
FIG. 5 is a side view showing adjacent ladder sections arranged in an obtuse angle configuration.
Figure 6:
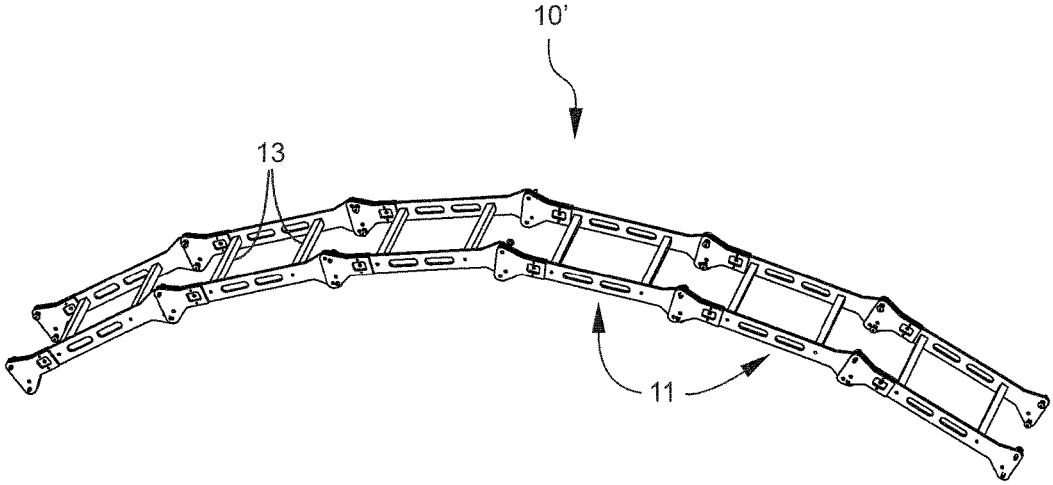
FIG. 6 is a perspective view of the exemplary ladder with adjacent ladder sections arranged in an obtuse angle configuration, and cooperating with a number of like modular ladder sections to form an arched ladder.

Referring to FIGS. 2, 5 and 6, the present ladder 10 can be readily converted from a straight-ladder configuration by moving the quick-release detent pins 41, 42 to a second pair of aligned holes 32, 33 in the connector plates 15A-15B and 16 of adjacent ladder sections 11A, 11B, such that the ladder sections 11A, 11B are arranged in an obtuse angle configuration. In one example, the obtuse angle "oa" formed by adjacent ladder sections 11A, 11B is between 120 and 170 degrees. In the obtuse angle configuration, the first and second ladder sections 11A, 11B may cooperate with a number of like modular ladder sections to form an arched ladder 10' (e.g., for bridging from one structure to another). The exemplary arched ladder 10' comprises six modular 2-ft ladder sections 11. When used as an arched or straight-structure bridge, the exemplary ladder 10' can span openings up to about 11-ft wide. Bridging insert panels (not shown) may be installed over or between the rungs 13 to increase step surface area and thus enhancing safety. The breaching hooks 51, 52 are not typically used when bridging between two points separated by a drop.

Figure 7:
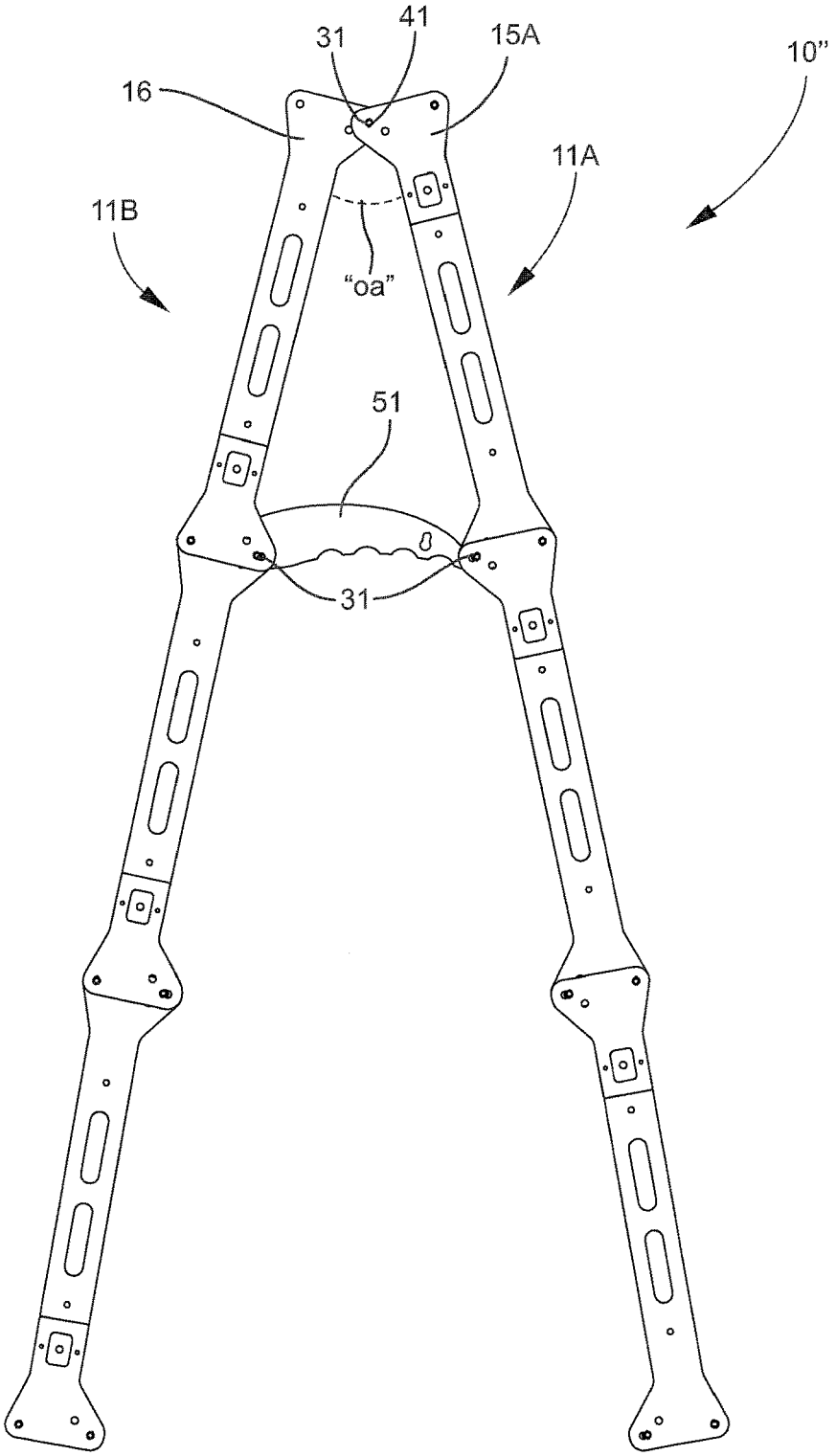
FIG. 7 is a side view of the exemplary ladder with adjacent top ladder sections arranged in an acute angle configuration, and cooperating with a number of like modular ladder sections and spacers to form an A-frame ladder.

Referring to FIGS. 2 and 7, in yet another implementation the exemplary ladder 10" may be converted to a generally conventional A-frame structure by inserting a single pin 41 through aligned pin holes 31 in connector plates 15A-15B and 16 of adjacent ladder sections 11A, 11B, and pivoting the joined ladder sections 11A, 11B into an acute angle configuration. In this exemplary configuration, the acute angle "aa" formed by adjacent pivoted ladder sections may be between 0 and 80 degrees. The ladder sections 11A, 11B form an inverted V, and may cooperate with like modular ladder sections in straight-ladder configurations to extend the A-frame structure (or step ladder) vertically to 4 feet or more. For stability and bracing, the breaching hooks 51, 52 may be pinned to connector plates 15A, 15B through respective holes 61, 62, and 31 formed with the hooks and plates (See FIGS. 2 and 4).

FIGS. 8-13 demonstrate an exemplary process for disassembling the convertible ladder 10 from an extended deployed condition, and subsequently reassembling the ladder 10 into a compact stowed condition for convenient transport and storage. In the example shown, the ladder 10 comprises three modular 2-foot rigid ladder sections 11—although the same principles described herein relate equally to any other number of modular sections.

Figure 8:
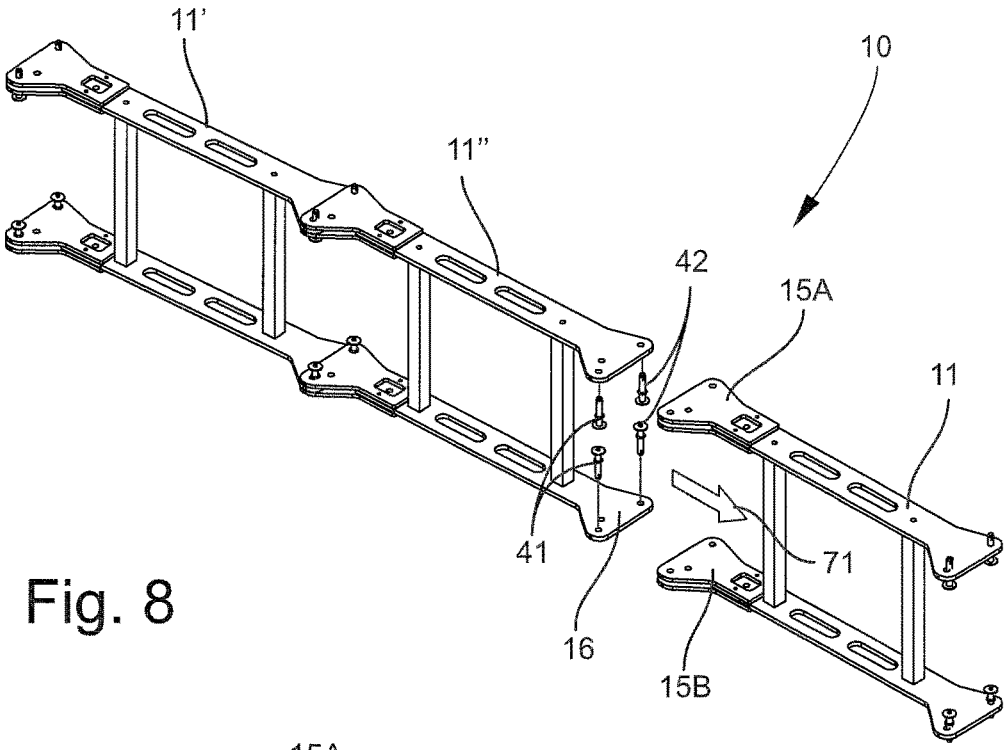
FIGS. 8-13 are views demonstrating sequential disassembly and folding of the exemplary ladder into a stowed condition.
Figure 9:
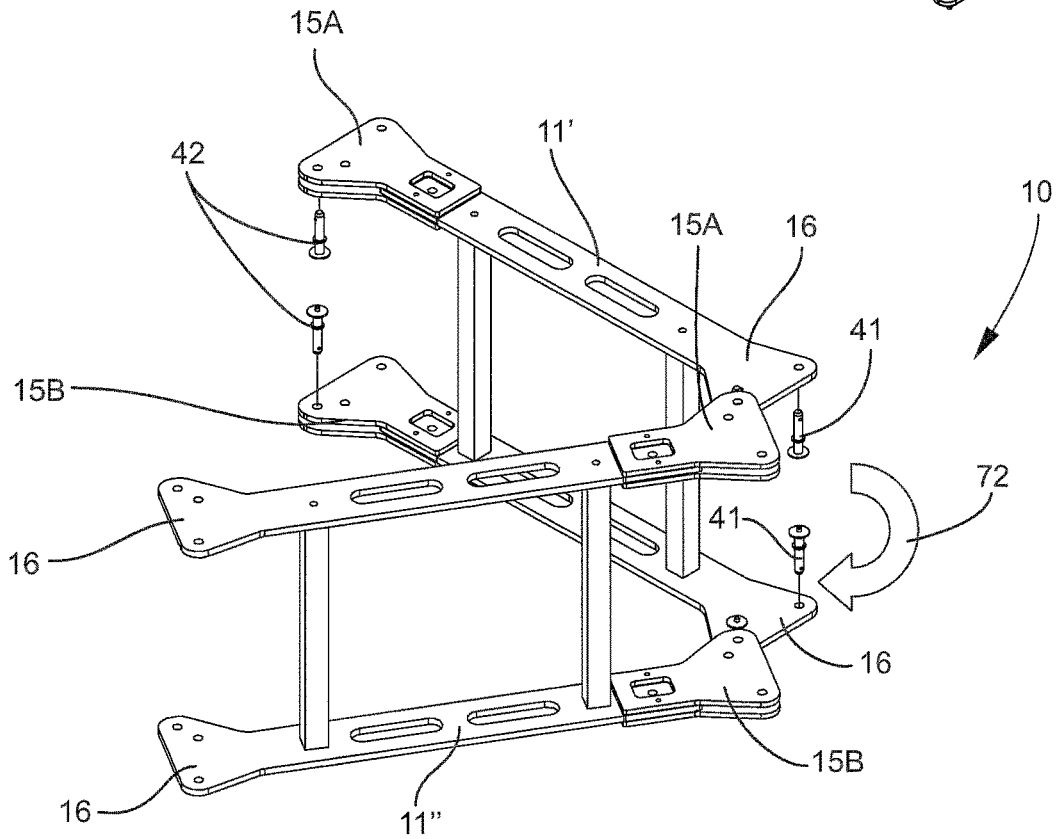
Figure 10:
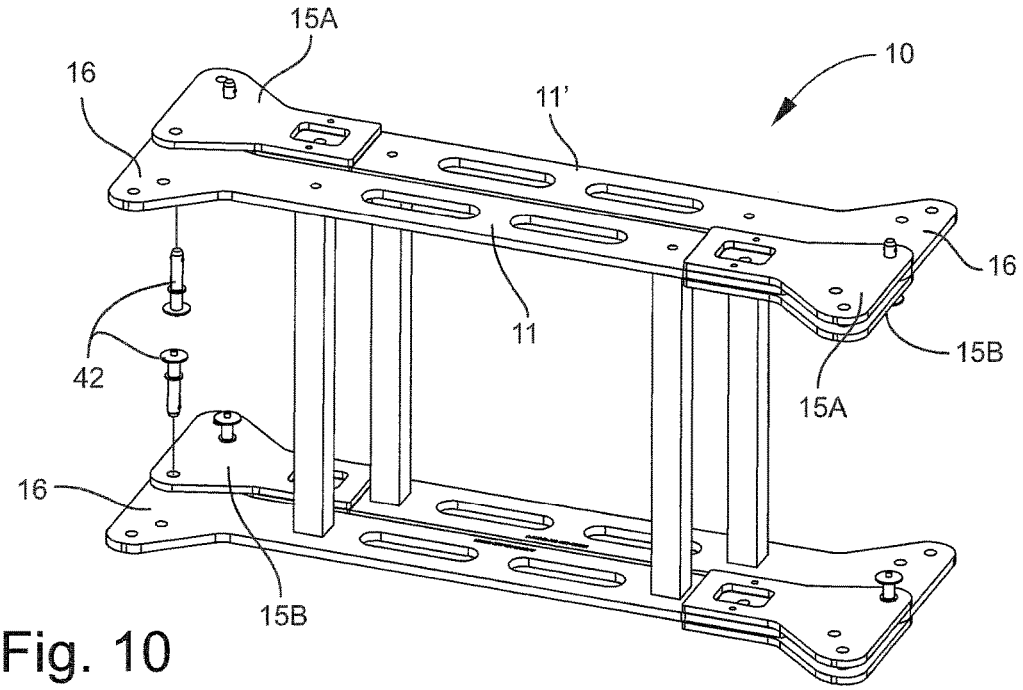
Figure 11:
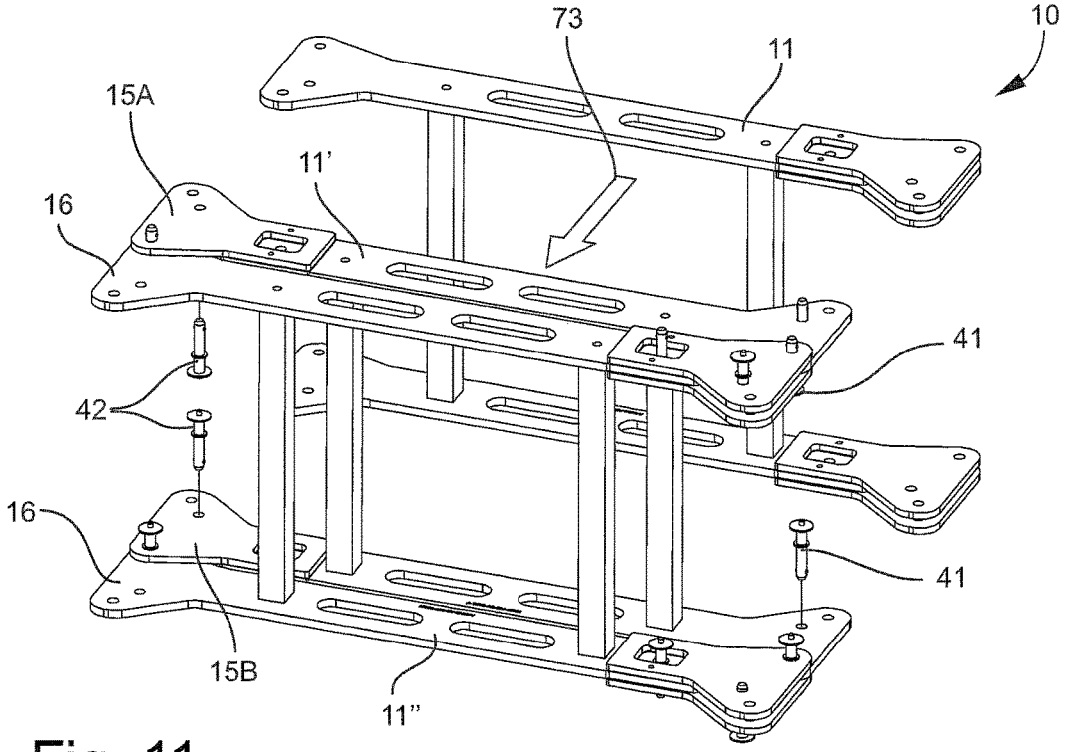
Figure 12:
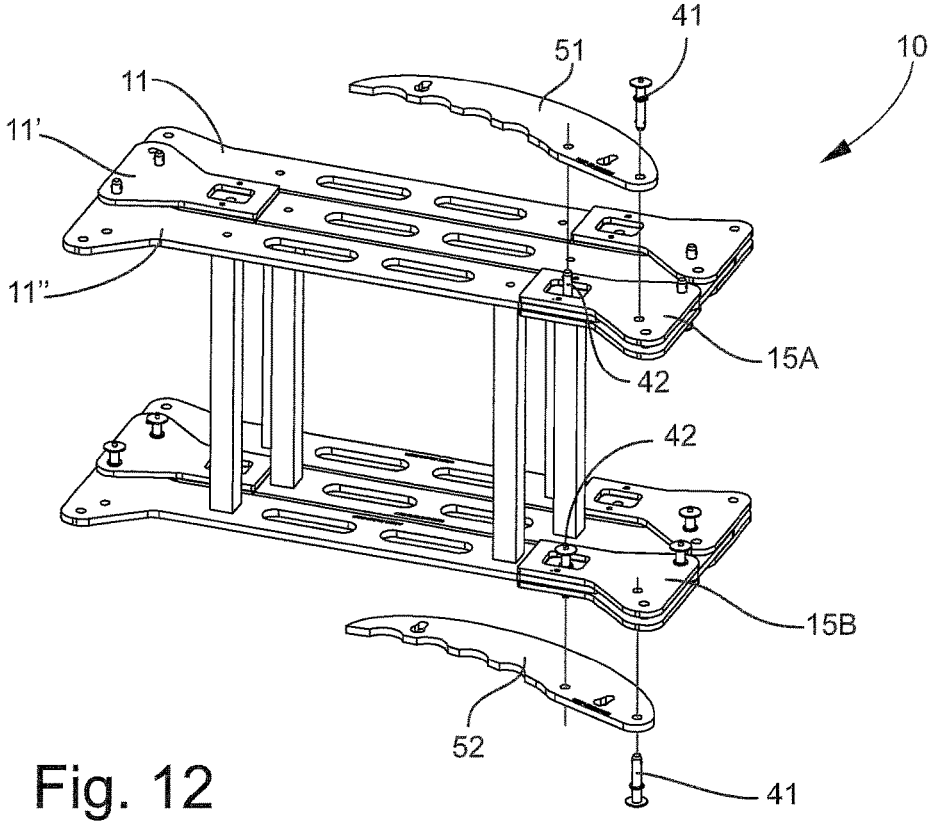
Figure 13:
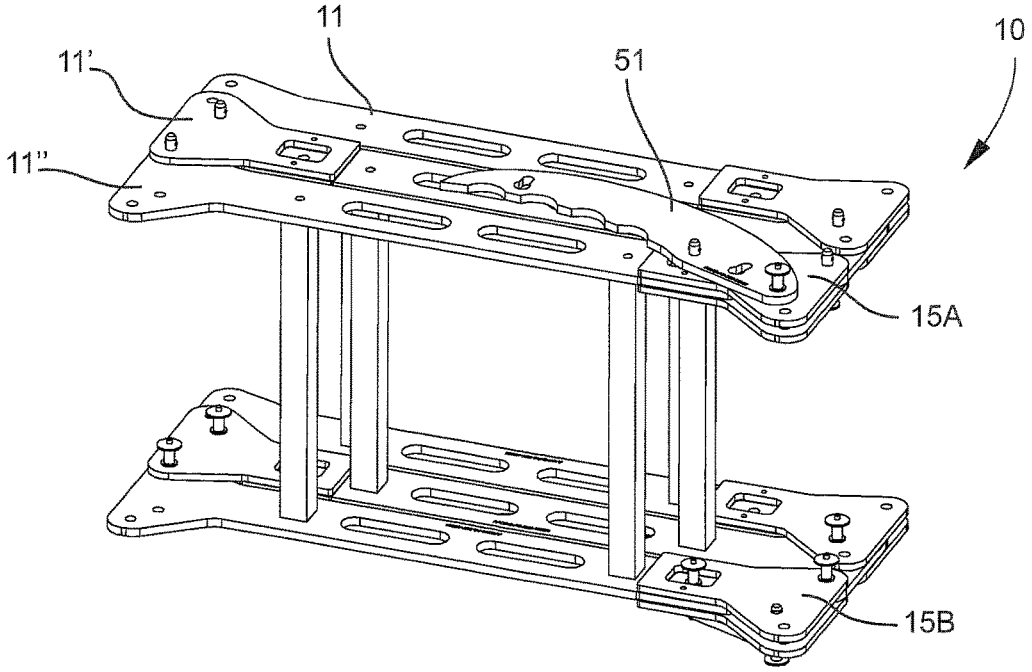

Referring to FIGS. 8 and 9, from the straight-ladder configuration the first end ladder section 11 is removed and separated (as indicated by arrow 71) by removing the detent pins 41, 42 from aligned openings in the connector plates 15A-15B and 16. Pins 41, 42 are then removed from the second end ladder section 11', and the intermediate ladder section 11" pivoted and folded as indicated at arrow 72. Once folded, the intermediate ladder section 11" and second end ladder section 11' are joined together by inserting pins 42 through aligned openings in the connector plates 15A-15B and 16 as shown in FIG. 10. The first end ladder section 11 is then joined to the second end ladder section 11', as indicated by arrow 73 in FIG. 11, using pins 41, 42 extending through aligned holes in connector plates 15A-15B and 16. Finally, as shown in FIGS. 12 and 13, the two breaching hooks 51, 52 may be attached to the intermediate ladder section 11" using pins 41, 42 inserted through aligned holes in the connector plates 15A-15B. When stowed as a three-section unit, the overall size of the ladder 10 is reduced to 26" L×13" W×11" D. The exemplary three-section ladder 10 may be constructed of aluminum, and may weigh less than 25 pounds.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed:

1. A convertible folding ladder adapted for adjustment between a substantially straight ladder configuration, an obtuse angle configuration, and an acute angle configuration, comprising:

a first rigid ladder section comprising opposing spaced apart longitudinal rails, a plurality of spaced apart rungs of said first ladder section between said rails of said first ladder section, and a first connector plate formed with one end of at least one of said longitudinal rails, said first connector plate comprising an enlarged asymmetric head having a straight distal edge extending perpendicular to a length of said longitudinal rail of said first ladder section, and projecting laterally outwardly from said longitudinal rails, thereby forming a first standoff adapted for spacing the ladder rungs of said first ladder section away from a vertical structure against which said folding ladder is leaned when in the straight ladder configuration, and said first connector plate of said first ladder section defining first and second pin holes formed in the first standoff, and longitudinally and laterally spaced apart from each other relative to a longitudinal axis of said first ladder section, and a third pin hole formed in said first connector plate opposite the first standoff, and longitudinally aligned with the first pin hole;

a second rigid ladder section comprising opposing spaced apart longitudinal rails, a plurality of spaced apart rungs of said second ladder section between said rails of said second ladder section, and a second connector plate formed with one end of at least one of said rails of said second ladder section, said second connector plate comprising an enlarged asymmetric head having a straight distal edge extending perpendicular to a length of said longitudinal rail of said second ladder section, and projecting laterally outwardly from said longitudinal rails, thereby forming a second standoff adapted for spacing the ladder rungs of said second ladder section away from a vertical structure against which said folding ladder is leaned when in the straight ladder configuration, and said second connector plate of said second ladder section defining first and second pin holes formed in the second standoff, and longitudinally and laterally spaced apart from each other relative to a longitudinal axis of said second ladder section, and a third pin hole formed in said second connector plate opposite the second standoff, and longitudinally aligned with the first pin hole, whereby the pin holes defined by said second connector plate of said second ladder section are adapted for being selectively aligned in pairs with pin holes defined by said second connector plate of said first ladder section; and first and second fastener pins adapted for being removably inserted through respective aligned pin holes defined by said first and second connector plates of said first and second ladder sections, such that:

(i) aligning said first and third pin holes of said first connector plate with said first and third pin holes of said second connector plate and inserting said first and second fastener pins through said first and third aligned pin holes formed in respective first and second connector plates arranges said first and second ladder sections in the substantially straight ladder configuration; and (ii) aligning said second and third pin holes of said first connector plate with said second and third pin holes of said second connector plate and inserting said first and second fastener pins through said second and third aligned pin holes formed in respective first and second connector plates arranges said first and second ladder sections in the obtuse angle configuration, wherein said ladder sections cooperate to form an arched ladder structure; and (iii) aligning said third pin hole of said first connector plate with said third pin hole of said second connector plate and inserting one of said first and second fastener pins through said third aligned pin hole formed in respective first and second connector plates enables arrangement of said first and second ladder sections in the acute angle configuration, wherein said ladder sections cooperate to form an A-frame ladder structure.

2. A convertible folding ladder according to claim 1, wherein in said obtuse angle configuration said first and second ladder sections are arranged at angle of between about 120-170 degrees.

3. A convertible folding ladder according to claim 1, wherein in said acute angle configuration said first and second ladder sections are arranged at angle of between about 0-80 degrees.

4. A convertible folding ladder according to claim 1, and comprising at least one rigid spacer removably attached to said first and second ladder sections in said acute angle configuration.

5. A convertible folding ladder according to claim 1, wherein each of said first and second fastener pins comprises a quick-release spring-loaded detent pin.

6. A convertible folding ladder according to claim 1, and comprising at least one breaching hook removably attached to one of said first and second ladder sections, and adapted for hanging said ladder from a vertical structure in the substantially straight ladder configuration.

7. A convertible folding ladder according to claim 1, wherein said first and second ladder sections comprise respective identical interchangeable modular ladder sections.

8. A convertible folding ladder according to claim 7, wherein each of said modular ladder sections is between 2-4 feet in length.

* * * * *